US009543691B2

(12) United States Patent
Watkins

(10) Patent No.: US 9,543,691 B2
(45) Date of Patent: Jan. 10, 2017

(54) COAXIAL CABLE CONNECTOR HAVING AN ACTIVATABLE SEAL

(71) Applicant: PPC Broadband, Inc., East Syracuse, NY (US)

(72) Inventor: Harold J. Watkins, Chittenango, NY (US)

(73) Assignee: PPC Broadband, Inc., East Syracuse, NY (US)

( * ) Notice: Subject to any disclaimer, the term of this patent is extended or adjusted under 35 U.S.C. 154(b) by 108 days.

(21) Appl. No.: 14/659,829

(22) Filed: Mar. 17, 2015

(65) Prior Publication Data

US 2015/0263449 A1 Sep. 17, 2015

Related U.S. Application Data

(60) Provisional application No. 61/954,177, filed on Mar. 17, 2014.

(51) Int. Cl.

| | |
|---|---|
| ***H01R 13/52*** | (2006.01) |
| *H01R 9/05* | (2006.01) |
| *H01R 13/622* | (2006.01) |

(52) U.S. Cl.

CPC ..... *H01R 13/5219* (2013.01); *H01R 13/5202* (2013.01); *H01R 9/05* (2013.01); *H01R 13/622* (2013.01)

(58) Field of Classification Search

CPC ..... H01R 13/5219; H01R 13/622; H01R 13/5208; H01R 24/40; H01R 2103/00; H01R 9/0521

USPC ..... 439/277, 322, 583, 578, 587

See application file for complete search history.

(56) References Cited

U.S. PATENT DOCUMENTS

| | | | | |
|---|---|---|---|---|
| 5,671,833 | A | 9/1997 | Edwards et al. | |
| 6,217,383 | B1 | 4/2001 | Holland et al. | |
| 7,942,694 | B2 | 5/2011 | Amidon | |
| 8,002,579 | B2 | 8/2011 | Alrutz | |
| 8,029,315 | B2 * | 10/2011 | Purdy | H01R 9/0521 439/578 |
| 8,038,473 | B2 | 10/2011 | Amidon | |
| 8,376,765 | B2 | 2/2013 | Chaize | |
| 8,469,739 | B2 * | 6/2013 | Rodrigues | H01R 13/622 439/578 |
| 8,816,196 | B2 | 8/2014 | Williams et al. | |
| 9,153,911 | B2 * | 10/2015 | Burris | H01R 13/6581 |
| 9,190,744 | B2 * | 11/2015 | Burris | H01R 9/05 |
| 9,287,659 | B2 * | 3/2016 | Burris | H01R 9/0524 |
| 2004/0209516 | A1 | 10/2004 | Burris et al. | |
| 2008/0311790 | A1 | 12/2008 | Malloy et al. | |
| 2011/0003498 | A1 | 1/2011 | Amidon | |
| 2011/0117775 | A1 | 5/2011 | Alrutz | |

(Continued)

OTHER PUBLICATIONS

Sep. 2, 2015 International Search Report and Written Opinion issued in International Application No. PCT/US2015/020977.

*Primary Examiner* — Hien Vu
(74) *Attorney, Agent, or Firm* — Oliff PLC

(57) ABSTRACT

A connector including a cavity for stowing a pre-installed sealing member. The sealing cavity is defined by a first or coupler seal cavity formed on the inside surface of a coupler and a second or insert seal cavity formed on the outer periphery of an insert. Relative motion of the coupler and the insert during assembly causes the sealing member to be displaced from a stowed or inactive seal position to an assembled or active seal position.

26 Claims, 10 Drawing Sheets

(56) References Cited

U.S. PATENT DOCUMENTS

| | | | |
|---|---|---|---|
| 2011/0207355 | A1 | 8/2011 | Amidon |
| 2012/0282804 | A1 | 11/2012 | Rodrigues et al. |

* cited by examiner

COAXIAL CABLE CONNECTOR HAVING AN ACTIVATABLE SEAL

CROSS-REFERENCE TO RELATED APPLICATION

This application is a Non-Provisional Patent Application, and claims the benefit and priority of U.S. Provisional Patent Application No. 61/954,177, filed on Mar. 17, 2014. The entire content and disclosure of such an application are hereby incorporated by reference.

BACKGROUND

Coaxial cable connectors typically incorporate moisture seals to prevent rain/humidity/condensation from degrading signal quality. When installing, assembling, and/or reassembling a coaxial cable connector with an interface port, a service technician typically interposes a sealing member, such as an O-ring seal, between the nut of the connector and the interface port. In view of this requirement, service technicians routinely maintain an inventory of different types and sizes of O-rings and sealing washers/structures to ensure that a proper sealing member is available as connections are made. Furthermore, inasmuch as sealing members typically differ in size by only a few thousandths or millimeters of an inch, they can be difficult to visually differentiate. As a result, it can be difficult to maintain the requisite level of inventory control to ensure that a proper sealing member has been installed. For example, a service technician may be unable to detect or ascertain when a sealing member has been incorrectly selected and/or improperly installed. In addition to the burden of managing inventory, in-field installation of sealing members can introduce inconsistencies in the quality of the connections, and improperly installed or seated sealing members can cause significant problems with the operation of the cable connectors.

The foregoing describes some, but not necessarily all, of the problems, disadvantages and challenges related to sealing coaxial cable connectors.

SUMMARY

In one embodiment, a connector comprises a body, a post internal of the body, a coupler connected to the body, a sealing member operative to form a seal between the coupler and the post, and an interface port.

The body includes a bearing surface and defines a bore disposed about an elongate axis. Further, the body is configured to receive a prepared end of a coaxial cable and has a dielectric core disposed between an inner conductor and an outer conductor. The coupler rotationally mounts to a bearing surface of the body and has: (i) a plurality of threads configured to engage a threaded interface port, (ii) an axial recess disposed aft of the threads, (iii) an inwardly facing annular coupler groove defining a seal coupler cavity, and (iv) aft sealing coupler surface.

The post has a head end and a rear end portion. The head end portion includes first and second circumferential ridges along an outer periphery of the head end portion wherein the first and second circumferential ridges define a seal post cavity therebetween when the connector is assembled and before the connector is installed on a cable.

The sealing member is configured to fit between the seal coupler cavity and the seal post cavity when the connector is assembled and before the connector is installed on a cable. The seal coupler cavity and the seal post cavity cooperate so as to selectively maintain the sealing member in an inactive seal position when the connector is assembled and before the connector is installed on a cable. The seal post cavity is formed by a concave surface shaped to fit a portion of the sealing member so as to selectively maintain the sealing member in the inactive seal position when the connector is assembled and before the connector is installed on a cable. Further, the post and the coupler are arranged to move between a first and a second coupler-to-post position. In the first coupler-to-post position, the sealing member is in the inactive seal position between the seal coupler cavity and the seal post cavity. In the inactive seal position, the sealing member does not form a seal between the coupler and the post. In an active seal position, the sealing member forms a seal between the coupler and the post.

Additionally, the first seal coupler cavity includes a shoulder which extends a first radial distance from a longitudinal axis of the connector and the sealing member defines a centroid which extends a second radial distance from the longitudinal axis. The first radial distance of the shoulder is less than the second radial distance of the centroid of the sealing member.

The post and the coupler are configured to lift and roll the sealing member from the inactive seal position to the active seal position: (i) when the post and the coupler move from the first coupler-to-post position to the second coupler-to-post position, (ii) when the coupler engages the interface port, and (iii) when the interface port causes the post to move toward the body. Specifically, the shoulder is configured to lift the sealing member over the first circumferential ridge when the post and the coupler move from the first coupler-to-post position to the second coupler-to-post position.

In another embodiment, a connector comprises a coupler member, a body member, a post member and a sealing member. The coupler member is configured to engage an interface port, and has an inwardly facing groove portion that forms a seal coupler cavity. The body member is arranged to engage the coupler member and the post member when the connector is assembled, and arranged to engage a cable when the connector is in an installed state, where the coupler member engages the interface port and where the body member engages a cable. The post member is configured to engage the interface port and move toward the body when the connector is installed on the interface port and the cable. The post member has an outwardly facing groove portion formed by a forward and aft ridge, the groove forming seal post cavity. The seal member is configured to fit between the seal coupler cavity and the seal post cavity when the connector is assembled and before the connector is installed between the interface port and the cable. Furthermore, the post is configured to move between a first and a second position. In the first position, the seal member is maintained in an inactive seal position between the seal coupler cavity and the seal post cavity when the connector is assembled and before the connector is installed on the interface port and the cable. In the second position, the seal member is in an active seal position and is spaced away from the inactive seal position. Furthermore, in this position the connector is installed between the interface port and the cable. Moreover, the seal coupler and seal post cavities cooperate to lift and roll the sealing member away from the inactive seal position and to the active seal position when the post moves from the first position to the second position and when the connector is installed between the interface port and the cable.

In another embodiment, a coupler member defines a coupler seal cavity and a post member defines a post seal cavity. The body member is configured to engage the coupler member and the post member when the connector is assembled. Furthermore, the seal member is configured to be held in an inactive seal position between the coupler seal cavity and the post seal cavity when the connector is assembled and before the connector is in an port-to-cable installed state, where the coupler member engages an interface port and the body engages a cable.

The post member is configured to move from a first post position to a second post position spaced apart from the first post position. In the first position, the seal member is in the inactive seal position and does not form a seal between the coupler member and the post member. In the second post position the seal member is in an active seal position and forms a seal between the coupler member and the post member.

The coupler seal cavity and the post seal cavity are configured to cooperate together so as to lift and roll the seal member from the inactive seal position to the active seal position when the post member moves from the first post position to the second post position.

In another embodiment, a connector is provided including a body, a coupler rotatably attached to the body, and an insert configured to be received by the coupler. The coupler comprises a first seal cavity while the insert comprises a second seal cavity. The first and second seal cavities cooperate to define a seal holding cavity for securing or holding a sealing device in a deactivated or stowed position. During assembly, the insert moves relative to the coupler such that the second seal cavity displaces the sealing device from the stowed position to an active seal position. When in the active seal position the sealing device seals one or more interfaces between the coupler, insert and interface port.

DETAILED DESCRIPTION

Figure 1:
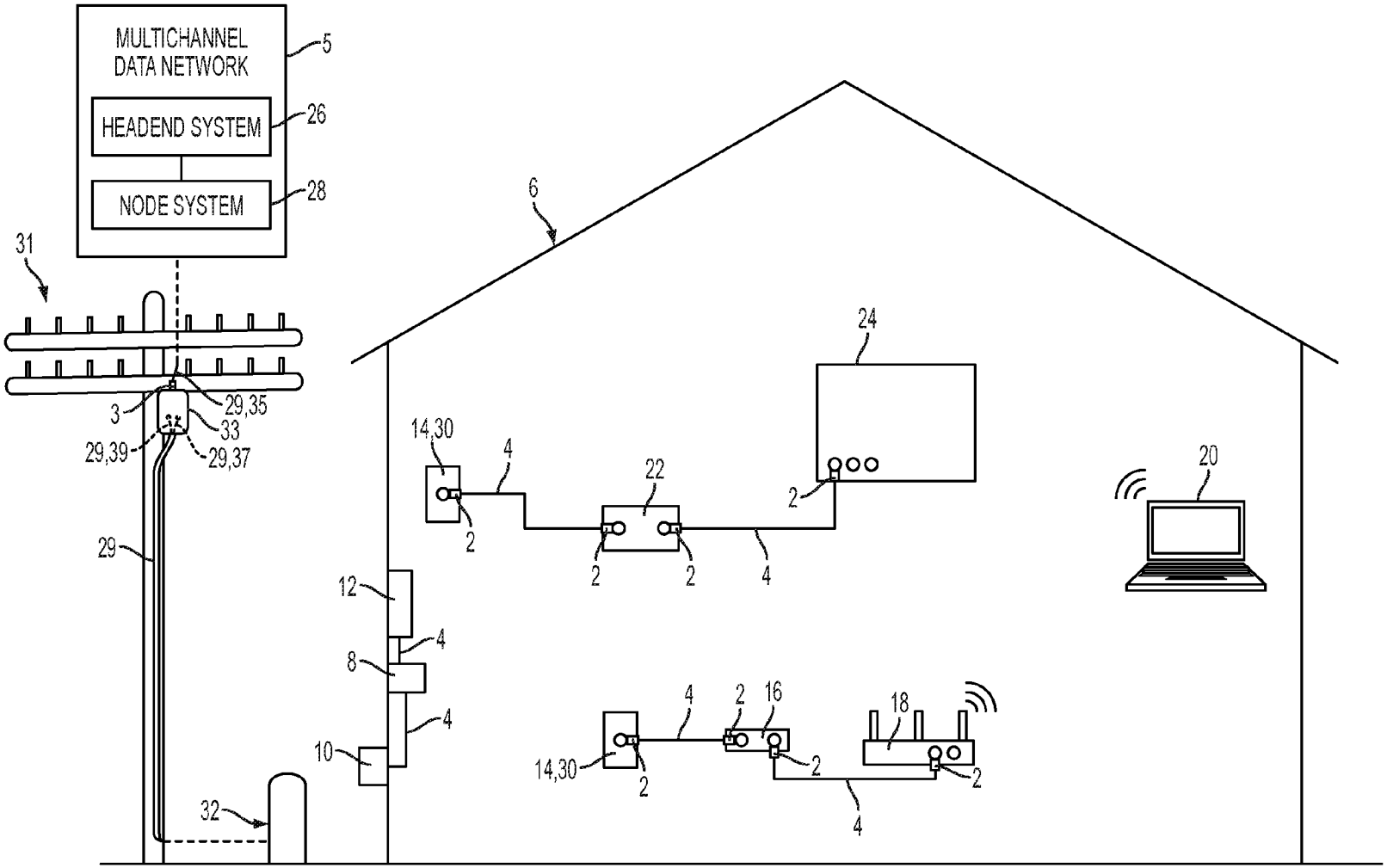
FIG. 1 is a schematic diagram illustrating an environment coupled to a multichannel data network.

Referring to FIG. 1, cable connectors 2 and 3 enable the exchange of data signals between a broadband network or multichannel data network 5, and various devices within a home, building, venue or other environment 6. For example, the environment's devices can include: (a) a point of entry ("PoE") filter 8 operatively coupled to an outdoor cable junction device 10; (b) one or more signal splitters within a service panel 12 which distributes the data service to interface ports 14 of various rooms or parts of the environment 6; (c) a modem 16 which modulates radio frequency ("RF") signals to generate digital signals to operate a wireless router 18; (d) an Internet accessible device, such as a mobile phone or computer 20, wirelessly coupled to the wireless router 18; and (e) a set-top unit 22 coupled to a television ("TV") 24. In one embodiment, the set-top unit 22, typically supplied by the data provider (e.g., the cable TV company), includes a TV tuner and a digital adapter for High Definition TV.

In one distribution method, the data service provider operates a headend facility or headend system 26 coupled to a plurality of optical node facilities or node systems, such as node system 28. The data service provider operates the node systems as well as the headend system 26. The headend system 26 multiplexes the TV channels, producing light beam pulses which travel through optical fiber trunklines. The optical fiber trunklines extend to optical node facilities in local communities, such as node system 28. The node system 28 translates the light pulse signals to RF electrical signals.

In one embodiment, a drop line coaxial cable or weather-protected or weatherized coaxial cable 29 is connected to the headend facility 26 or node facility 28 of the service provider. In the example shown, the weatherized coaxial cable 29 is routed to a standing structure, such as utility pole 31. A splitter or entry junction device 33 is mounted to, or hung from, the utility pole 31. In the illustrated example, the entry junction device 33 includes an input data port or input tap for receiving a hardline connector or male-type connector 3. The entry junction box device 33 also includes a plurality of output data ports within its weatherized housing. It should be appreciated that such a junction device can include any suitable number of input data ports and output data ports.

The end of the weatherized coaxial cable 35 is attached to a hardline connector or pin-type connector 3, which has a protruding pin insertable into a female interface data port of the junction device 33. The ends of the weatherized coaxial cables 37 and 39 are each attached to one of the connectors 2 described below. In this way, the connectors 2 and 3 electrically couple the cables 35, 37 and 39 to the junction device 33.

In one embodiment, the pin-type connector 3 has a male shape which is insertable into the applicable female input tap or female input data port of the junction device 33. The two female output ports of the junction device 33 are female-shaped in that they define a central hole configured to receive, and connect to, the inner conductors of the connectors 2.

In one embodiment, each input tap or input data port of the entry junction device 33 has an internally threaded wall configured to be threadably engaged with one of the pin-type connectors 3. The network 5 is operable to distribute signals through the weatherized coaxial cable 35 to the junction device 33, and then through the pin-type connector 3. The junction device 33 splits the signals to the pin-type connectors 2, weatherized by an entry box enclosure, to transmit the signals through the cables 37 and 39, down to the distribution box 32 described below.

In another distribution method, the data service provider operates a series of satellites. The service provider installs an outdoor antenna or satellite dish at the environment 6. The data service provider connects a coaxial cable to the satellite dish. The coaxial cable distributes the RF signals or channels of data into the environment 6.

In one embodiment, the multichannel data network 5 includes a telecommunications, cable/satellite TV ("CATV") network operable to process and distribute different RF signals or channels of signals for a variety of services, including, but not limited to, TV, Internet and voice communication by phone. For TV service, each unique radio frequency or channel is associated with a different TV channel. The set-top unit 22 converts the radio frequencies to a digital format for delivery to the TV. Through the data network 5, the service provider can distribute a variety of types of data, including, but not limited to, TV programs including on-demand videos, Internet service including wireless or WiFi Internet service, voice data distributed through digital phone service or Voice Over Internet Protocol (VoIP) phone service, Internet Protocol TV ("IPTV") data streams, multimedia content, audio data, music, radio and other types of data.

In one embodiment, the multichannel data network 5 is operatively coupled to a multimedia home entertainment network serving the environment 6. In one example, such multimedia home entertainment network is the Multimedia over Coax Alliance ("MoCA") network. The MoCA network increases the freedom of access to the data network 5 at various rooms and locations within the environment 6. The MoCA network, in one embodiment, operates on cables 4 within the environment 6 at frequencies in the range 1125 MHz to 1675 MHz. MoCA compatible devices can form a private network inside the environment 6.

In one embodiment, the MoCA network includes a plurality of network-connected devices, including, but not limited to: (a) passive devices, such as the PoE filter 8, internal filters, diplexers, traps, line conditioners and signal splitters; and (b) active devices, such as amplifiers. The PoE filter 8 provides security against the unauthorized leakage of a user's signal or network service to an unauthorized party or non-serviced environment. Other devices, such as line conditioners, are operable to adjust the incoming signals for better quality of service. For example, if the signal levels sent to the set-top box 22 do not meet designated flatness requirements, a line conditioner can adjust the signal level to meet such requirement.

In one embodiment, the modem 16 includes a monitoring module. The monitoring module continuously or periodically monitors the signals within the MoCA network. Based on this monitoring, the modem 16 can report data or information back to the headend system 26. Depending upon the embodiment, the reported information can relate to network problems, device problems, service usage or other events.

At different points in the network 5, cables 4 and 29 can be located indoors, outdoors, underground, within conduits, above ground mounted to poles, on the sides of buildings and within enclosures of various types and configurations. Cables 29 and 4 can also be mounted to, or installed within, mobile environments, such as land, air and sea vehicles.

As described above, the data service provider uses coaxial cables 29 and 4 to distribute the data to the environment 6. The environment 6 has an array of coaxial cables 4 at different locations. The connectors 2 are attachable to the coaxial cables 4. The cables 4, through use of the connectors 2, are connectable to various communication interfaces within the environment 6, such as the female interface ports 14 illustrated in FIGS. 1-2. In the examples shown, female interface ports 14 are incorporated into: (a) a signal splitter within an outdoor cable service or distribution box 32 which distributes data service to multiple homes or environments 6 close to each other; (b) a signal splitter within the outdoor cable junction box or cable junction device 10 which distributes the data service into the environment 6; (c) the set-top unit 22; (d) the TV 24; (e) wall-mounted jacks, such as a wall plate; and (f) the router 18.

Figure 2:
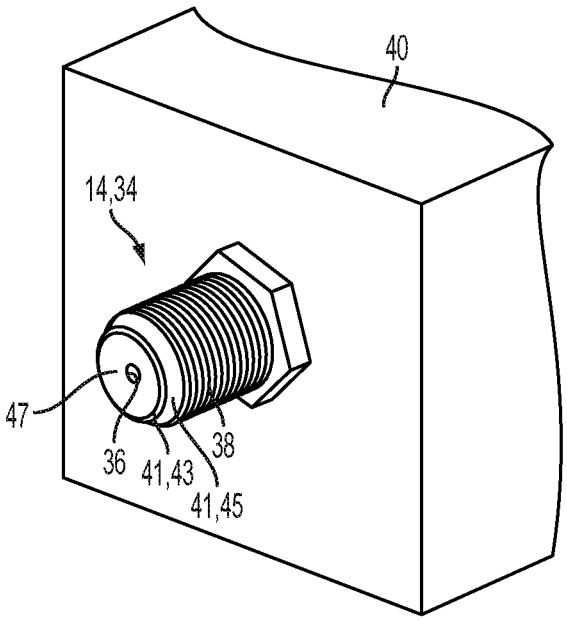
FIG. 2 is an isometric view of an interface port which is configured to be operatively coupled to the multichannel data network.
Figure 4:
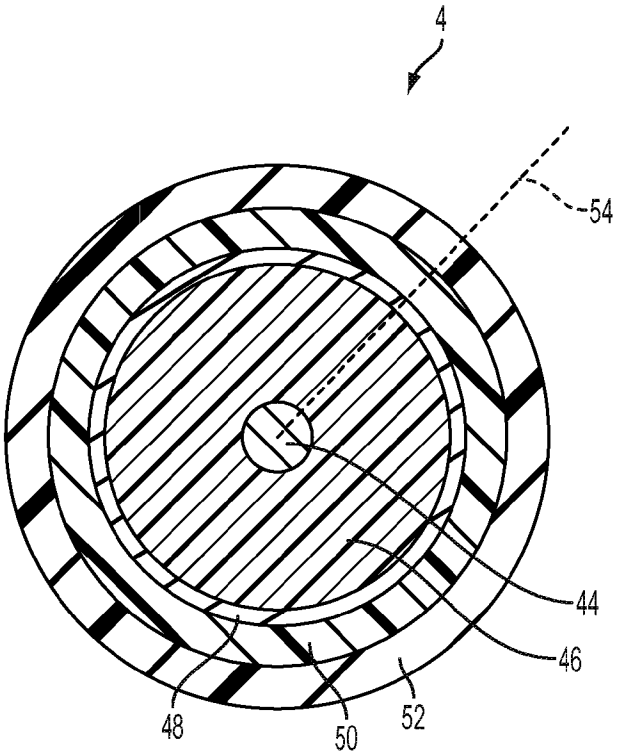
FIG. 4 is a cross-sectional view of the cable, taken substantially along line 4-4 of FIG. 3.

In one embodiment, each of the female interface ports 14 includes a stud or jack, such as the cylindrical stud 34 illustrated in FIG. 2. The stud 34 has: (a) an inner, cylindrical wall 36 defining a central hole configured to receive an electrical contact, wire, pin, conductor (not shown) positioned within the central hole; (b) a conductive, threaded outer surface 38; (c) a conical conductive region 41 having conductive contact sections 43 and 45; and (d) a dielectric or insulation material 47.

In one embodiment, stud 34 is shaped and sized to be compatible with the F-type coaxial connection standard. It should be understood that, depending upon the embodiment, stud 34 could have a smooth outer surface. The stud 34 can be operatively coupled to, or incorporated into, a device 40 which can include, for example, a cable splitter of a distribution box 32, outdoor cable junction box 10 or service panel 12; a set-top unit 22; a TV 24; a wall plate; a modem 16; a router 18; or the junction device 33.

During installation, the installer couples a cable 4 to an interface port 14 by screwing or pushing the connector 2 onto the female interface port 34. Once installed, the connector 2 receives the female interface port 34. The connector 2 establishes an electrical connection between the cable 4 and the electrical contact of the female interface port 34. After installation, the connectors 2 often undergo various forces. For example, there may be tension in the cable 4 as it stretches from one device 40 to another device 40, imposing a steady, tensile load on the connector 2. A user might occasionally move, pull or push on a cable 4 from time to time, causing forces on the connector 2. Alternatively, a user might swivel or shift the position of a TV 24, causing bending loads on the connector 2. As described below, the connector 2 is structured to maintain a suitable level of electrical connectivity despite such forces. Referring to FIGS. 3-6, the coaxial cable 4 extends along a cable axis or a longitudinal axis 42. In one embodiment, the cable 4 includes: (a) an elongated center conductor or inner conductor 44; (b) an elongated insulator 46 coaxially surrounding the inner conductor 44; (c) an elongated, conductive foil layer 48 coaxially surrounding the insulator 46; (d) an elongated outer conductor 50 coaxially surrounding the foil layer 48; and (e) an elongated sheath, sleeve or jacket 52 coaxially surrounding the outer conductor 50.

The inner conductor 44 is operable to carry data signals to and from the data network 5. Depending upon the embodiment, the inner conductor 44 can be a strand, a solid wire or a hollow, tubular wire. The inner conductor 44 is, in one embodiment, constructed of a conductive material suitable for data transmission, such as a metal or alloy including copper, including, but not limited, to copper-clad aluminum ("CCA"), copper-clad steel ("CCS") or silver-coated copper-clad steel ("SCCCS").

The insulator 46, in one embodiment, is a dielectric having a tubular shape. In one embodiment, the insulator 46 is radially compressible along a radius or radial line 54, and the insulator 46 is axially flexible along the longitudinal axis 42. Depending upon the embodiment, the insulator 46 can be a suitable polymer, such as polyethylene ("PE") or a fluoropolymer, in solid or foam form.

Figure 3:
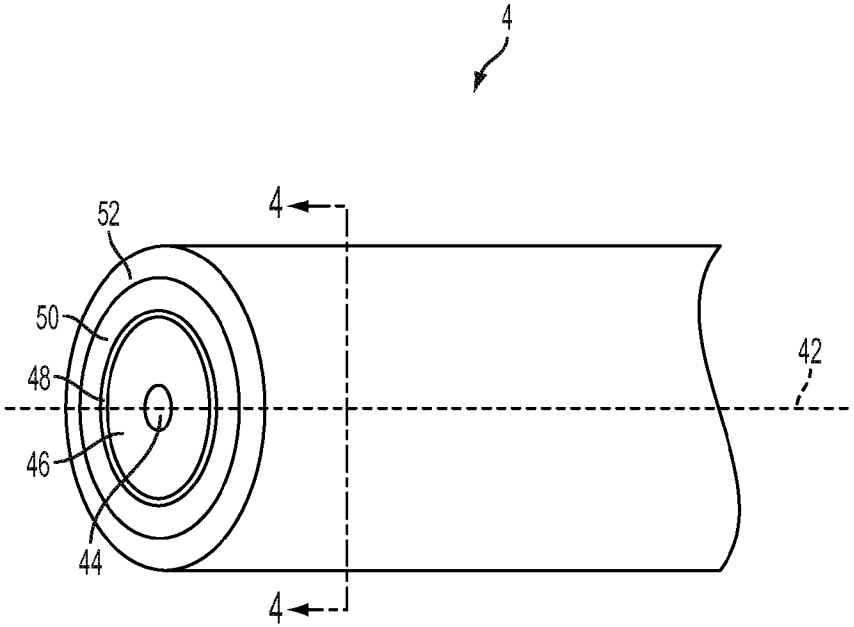
FIG. 3 is a broken-away isometric view of a cable which is configured to be operatively coupled to the multichannel data network.

In the embodiment illustrated in FIG. 3, the outer conductor 50 includes a conductive RF shield or electromagnetic radiation shield. In such embodiment, the outer conductor 50 includes a conductive screen, mesh or braid or otherwise has a perforated configuration defining a matrix, grid or array of openings. In one such embodiment, the braided outer conductor 50 has an aluminum material or a suitable combination of aluminum and polyester. Depending upon the embodiment, cable 4 can include multiple, overlapping layers of braided outer conductors 50, such as a dual-shield configuration, tri-shield configuration or quad-shield configuration.

In one embodiment, as described below, the connector 2 electrically grounds the outer conductor 50 of the coaxial cable 4. When the inner conductor 44 and external electronic devices generate magnetic fields, the grounded outer conductor 50 sends the excess charges to ground. In this way, the outer conductor 50 cancels all, substantially all or a suitable amount of the potentially interfering magnetic fields. Therefore, there is less, or an insignificant, disruption of the data signals running through inner conductor 44. Also, there is less, or an insignificant, disruption of the operation of external electronic devices near the cable 4.

In one such embodiment, the cable 4 has one or more electrical grounding paths. One grounding path extends from the outer conductor 50 to the cable connector's conductive post, and then from the connector's conductive post to the interface port 14. Depending upon the embodiment, an additional or alternative grounding path can extend from the outer conductor 50 to the cable connector's conductive body, then from the connector's conductive body to the connector's conductive nut or coupler, and then from the connector's conductive coupler to the interface port 14.

The conductive foil layer 48, in one embodiment, is an additional, tubular conductor which provides additional shielding of the magnetic fields. In one embodiment, the foil layer 48 includes a flexible foil tape or laminate adhered to the insulator 46, assuming the tubular shape of the insulator 46. The combination of the foil layer 48 and the outer conductor 50 can suitably block undesirable radiation or signal noise from leaving the cable 4. Such combination can also suitably block undesirable radiation or signal noise from entering the cable 4. This can result in an additional decrease in disruption of data communications through the cable 4 as well as an additional decrease in interference with external devices, such as nearby cables and components of other operating electronic devices.

In one embodiment, the jacket 52 has a protective characteristic, guarding the cable's internal components from damage. The jacket 52 also has an electrical insulation characteristic. In one embodiment, the jacket 52 is compressible along the radial line 54 and is flexible along the longitudinal axis 42. The jacket 52 is constructed of a suitable, flexible material such as polyvinyl chloride (PVC) or rubber. In one embodiment, the jacket 52 has a lead-free formulation including black-colored PVC and a sunlight resistant additive or sunlight resistant chemical structure.

Figure 5:
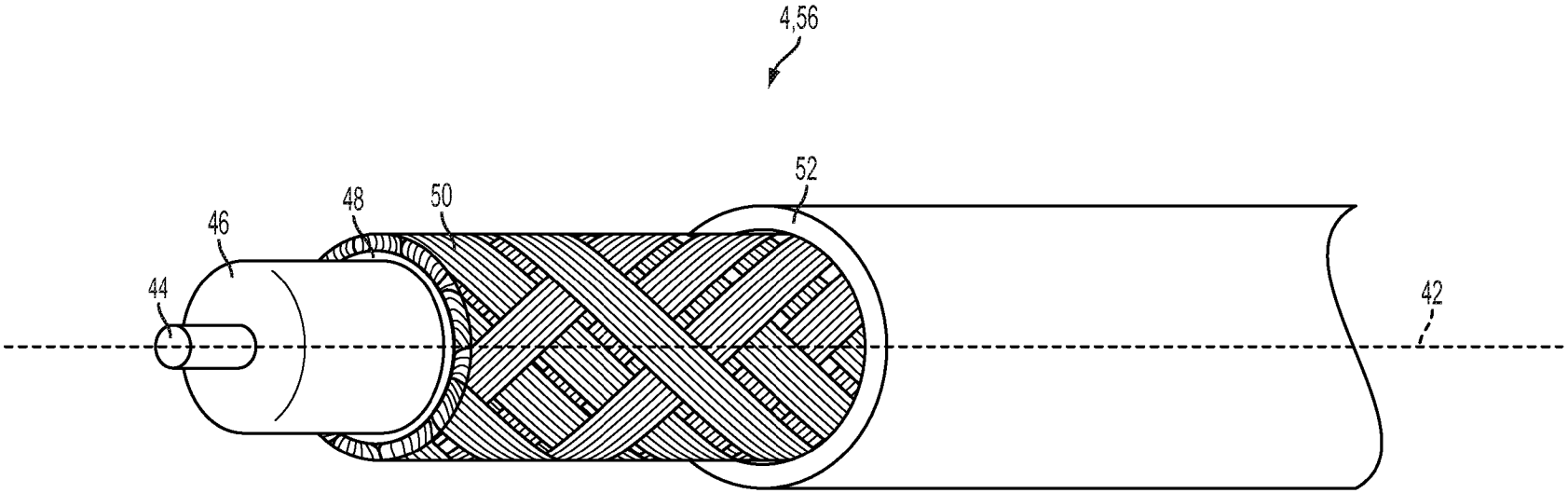
FIG. 5 is a broken-away isometric view of a cable which is configured to be operatively coupled to the multichannel data network, illustrating a three-stepped configuration of a prepared end of the cable.
Figure 6:
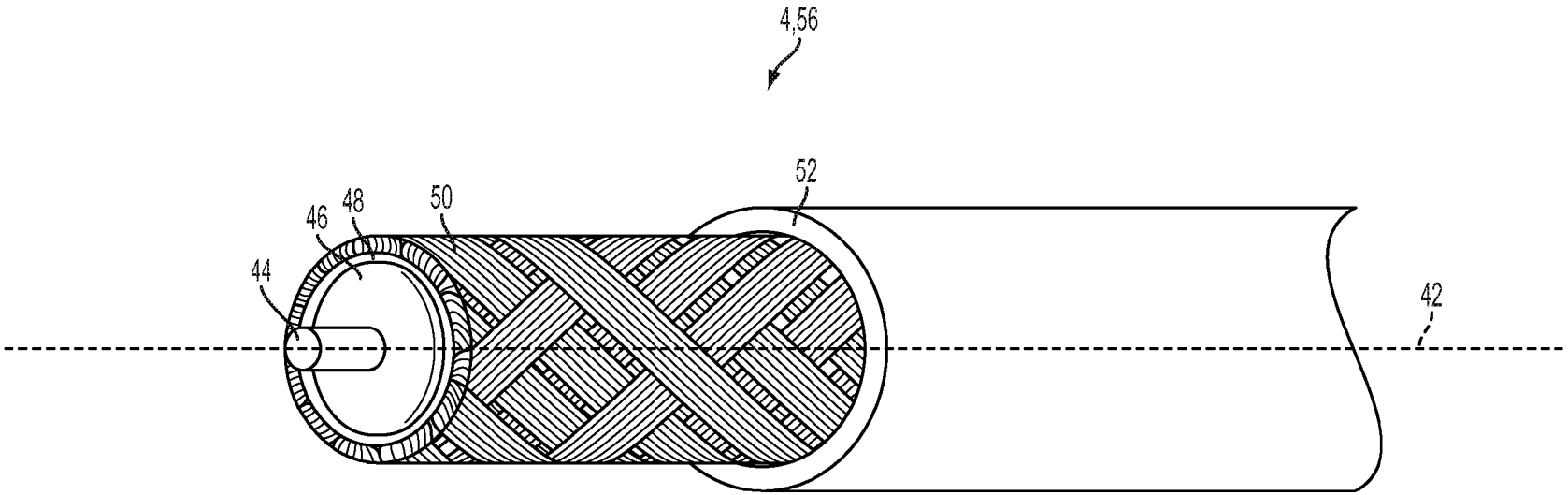
FIG. 6 is a broken-away isometric view of a cable which is configured to be operatively coupled to the multichannel data network, illustrating a two-stepped configuration of a prepared end of the cable.

Referring to FIGS. 5-6, in one embodiment an installer or preparer prepares a terminal end 56 of the cable 4 so that it can be mechanically connected to the connector 2. To do so, the preparer removes or strips away differently sized portions of the jacket 52, outer conductor 50, foil 48 and insulator 46 so as to expose the side walls of the jacket 52, outer conductor 50, foil layer 48 and insulator 46 in a stepped or staggered fashion. In the example shown in FIG. 5, the prepared end 56 has a three step-shaped configuration. In the example shown in FIG. 6, the prepared end 58 has a two step-shaped configuration. The preparer can use cable preparation pliers or a cable stripping tool to remove such portions of the cable 4. At this point, the cable 4 is ready to be connected to the connector 2.

Figure 7:
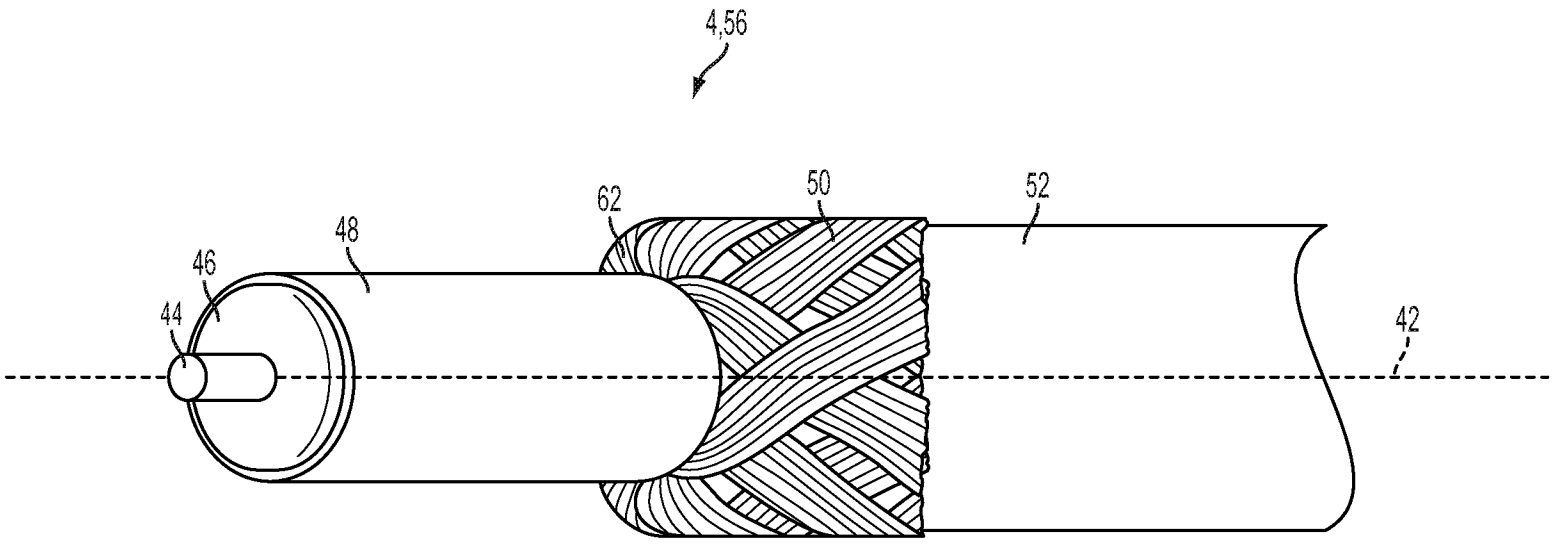
FIG. 7 is a broken-away isometric view a cable which is configured to be operatively coupled to the multichannel data network, illustrating the folded-back, braided outer conductor of a prepared end of the cable.

In one embodiment illustrated in FIG. 7, the installer or preparer performs a folding process to prepare the cable 4 for connection to connector 2. In the example illustrated, the preparer folds the braided outer conductor 50 backward onto the jacket 52. As a result, the folded section 60 is oriented inside out. The bend or fold 62 is adjacent to the foil layer 48 as shown. Certain embodiments of the connector 2 include a tubular post. In such embodiments, this folding process can facilitate the insertion of such post in between the braided outer conductor 50 and the foil layer 48.

Depending upon the embodiment, the components of the cable 4 can be constructed of various materials which have some degree of elasticity or flexibility. The elasticity enables the cable 4 to flex or bend in accordance with broadband communications standards, installation methods or installation equipment. Also, the radial thicknesses of the cable 4, the inner conductor 44, the insulator 46, the conductive foil layer 48, the outer conductor 50 and the jacket 52 can vary based upon parameters corresponding to broadband communication standards or installation equipment.

Figure 8:
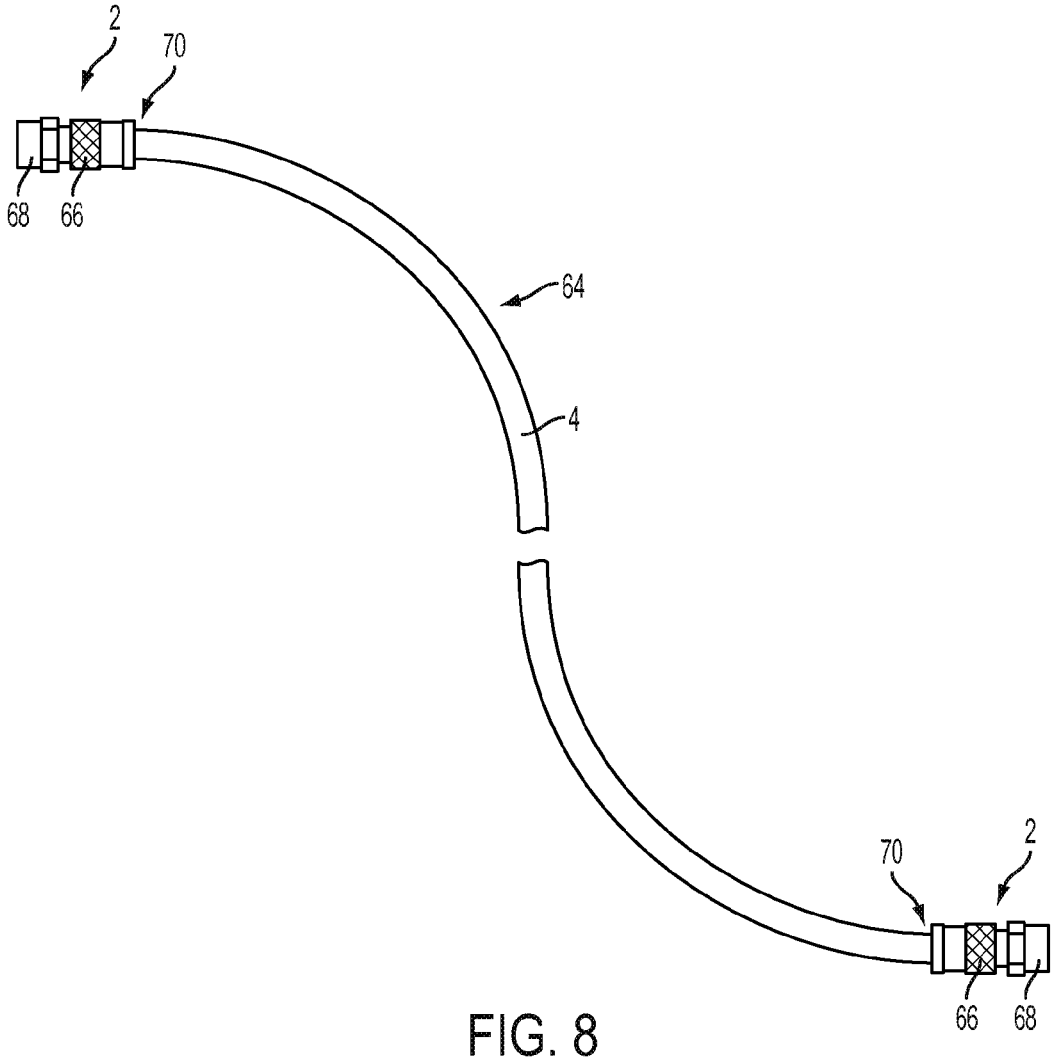
FIG. 8 is a top view of a cable jumper or cable assembly which is configured to be operatively coupled to the multichannel data network.

In one embodiment illustrated in FIG. 8, a cable jumper or cable assembly 64 includes a combination of the connector 2 and the cable 4 attached to the connector 2. In this embodiment, the connector 2 includes: (a) a connector body or connector housing 66; and (b) a fastener or coupler 68, such as a threaded nut, which is rotatably coupled to the connector housing 66. The cable assembly 64 has, in one embodiment, connectors 2 on both of its ends 70. Preassembled cable jumpers or cable assemblies 64 can facilitate the installation of cables 4 for various purposes.

In one embodiment the weatherized coaxial cable 29, illustrated in FIG. 1, has the same structure, configuration and components as coaxial cable 4 except that the weatherized coaxial cable 29 includes additional weather protective and durability enhancement characteristics. These characteristics enable the weatherized coaxial cable 29 to withstand greater forces and degradation factors caused by outdoor exposure to weather.

Figure 9:
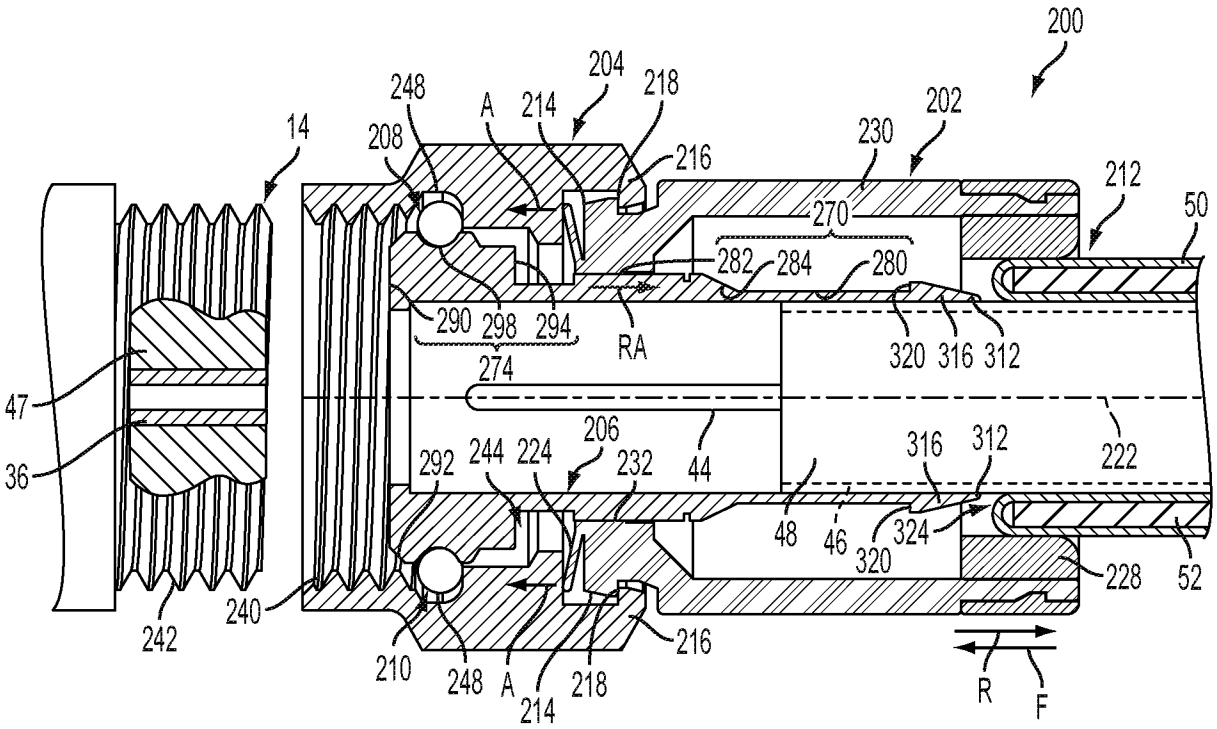
FIG. 9 is an sectioned view of a coaxial cable connector according to one embodiment of the disclosure showing the connector in a pre-activated position wherein a sealing member is prepositioned between a coupler and a post of the connector.
Figure 12:
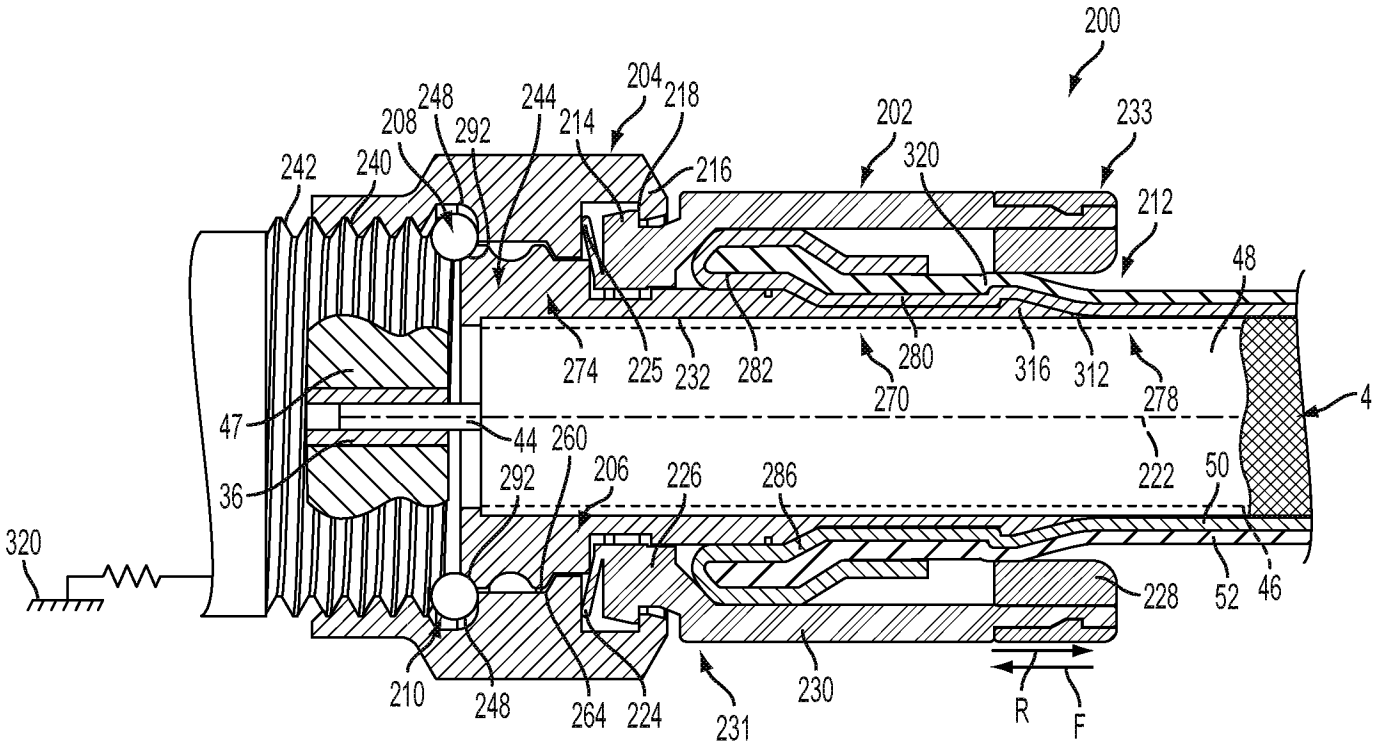
FIG. 12 is a sectioned view of the coaxial cable connector according to one embodiment showing the connector in an activated position wherein the post has been urged forward during assembly and repositioned relative to the sealing member such that the sealing member is disposed along a forward face surface of the post, i.e., in a seal support.

Referring to FIGS. 9 and 12, one embodiment of a cable connector 200 is depicted wherein the cable connector 200 couples a coaxial cable 4 to an interface port 14. Depending upon the embodiment, connector 200 can be an "F-type" connector or any other suitable type of connector, such as any connector having a post or sleeve operative to react to compressive loads induced by the body of the connector, or an external device, during assembly or installation with an interface port 14.

More specifically, the present disclosure is directed to connector 200 embodiment that may include a sealing member or member 208. Inasmuch as the names and functions can refer to a singular element or plural components, the terms "seal", "sealing member", or "sealing member" may be used interchangeably herein. As illustrated in FIG. 9, when the connector 200 is manufactured and packaged for distribution, the sealing member or member 208 may initially be located or positioned in a first coupler-to post position or state A (alternatively referred to as a pre-positioned, deactivated, inactive, stowed or port in-accessible position or first assembled position). By incorporating the sealing member 208 into the process of assembling the connector 200 during manufacture, it may be integrated with the connector 200 without subsequent external influences, which might adversely impact installation of the connector and its operation. Moreover, the sealing member or member 208 may be incorporated with the connector 200 in a controlled work environment before installation to improve accuracy and reliability during the installation process. As a result, such a connector 200 embodiment with a sealing member or member 208 may prevent a technician in the field from either improperly positioning the sealing member 208, or selecting an incorrect seal during the installation process.

During in-field installation, a service technician may cause the sealing member 208 to displace from the first position or state A, as shown in FIG. 9, to a second coupler-to-post position, or state B (alternatively referred to as an active, active seal, engaged, ready, or port accessible position, or second assembled position) as shown in FIG. 12. In the second position B, the sealing member 208 may be precisely seated between the post 206 and the interlace port 14 to form a seal therebetween. Accordingly, the sealing member 208 is in two functional states, a first assembled state when the sealing member 208 is stowed between the first and second seal cavities 248, 298 and a second assembled state when the sealing member 208 is sealed against an interface port 14. By pre-positioning the sealing member 208 in the first assembled position A within the connector 200 in advance, the risk of selecting or installing an incorrect seal may be significantly reduced. Furthermore, such pre-positioning of the seal member 208 may significantly enhance the reliability and effectiveness of the seal.

The relevant components of a coaxial cable connector 200 according the present disclosure are depicted in FIG. 9. Therein, the connector 200 includes a body 202, a fastener, nut or coupler 204 rotatably attached to the body 202, an insert or post 206 coaxially aligned with the body 202, and a seal or sealing member 208. In the described embodiment, the body 202, coupler 204 and post 206 are ferromagnetic, i.e., conductive, to facilitate the flow of current across the elements 202, 204, 206. Each of the elements 202, 204, 206 may be fabricated entirely from a metallic material, or alternatively, may have conductive surfaces/traces to enable and direct current flow. The seal, sealing device or sealing member 208 may be formed as an "O-ring" element and, consequently, the terms "sealing member," "O-ring," or "sealing ring" may be used interchangeably to describe a circular or ring-shaped element. It will be appreciated, however, that a seal or sealing member 208 of any variety is contemplated. Moreover, the sealing member 208 may have any of a variety of cross-sectional shapes including oval, elliptical, polygonal, etc.

In one embodiment, the coupler 204 may cooperate with the post 206 to pre-position the sealing member 208 in the inactive seal position A within the connector 200, where the sealing member does not form a seal between the coupler 204 and the post 206. That is, the sealing member 208 may be captured, stored or stowed in a seal storage structure 210 (alternatively referred to as a seal holding cavity, groove, space, or concave surface), which may be shaped to fit or surround a portion of the sealing member 208 so as to store it within an assembled connector 200 during shipment and handling of the connector 200, i.e., before the installation process where the connector 200 is actually connected to a cable 4 at one end and to and the interface port 14 at the other end.

Referring to FIGS. 9 through 12, when a service technician rotates, screws, or pushes the connector 200 onto the interface port 14, the port 14 may urge the post 206 axially toward a rearward direction, i.e., in the direction of arrow R toward the rearward end 228 of the body 202. This may cause the sealing member 208 to be dislodged or released from its deactivated position A (FIGS. 9 and 10) within the seal storage structure 210, to its activated position B (FIGS. 11 and 12), which is located forward of the post 206. For the purpose of providing a frame of reference and/or establishing a spatial relationship between the body 202, coupler 202, post 206 and sealing element 208, a generally forward direction may be illustrated by an arrow F, while a generally rearward or aft direction may be illustrated by the arrow R.

In the described embodiment, the body 202 may define an opening 212 at the rearward end 228 thereof and is configured to receive a conventional coaxial cable 4 such as that described earlier in connection with FIGS. 3 through 5. The opening 212 of the body 202 may receive the inner conductor 44, insulator or dielectric core 46, and conductive foil 48 which form a first step in the coaxial cable 4. The conductive foil 48 may wrap the dielectric core 46 to separate the core 46 from the outer conductor 50. The outer conductor 50 may be cut at one point/position along the cable 4 while the jacket 52 is cut at another position such that the outer conductor 50 may be folded back over the jacket 52. These additional cuts may form second and third steps in the coaxial cable 4.

Returning to FIG. 9, the body 202 may include an outwardly projecting lip or flange 214 at a forward end thereof adapted to rotatably mate with the coupler 204. Similarly, the coupler 204 may include an inwardly facing lip or flange 216 that may be arranged to bear against the outwardly facing flange 214 along a mating interface 218. The mating interface 218 may be structured to facilitate rotary motion of the coupler 204 relative to the body 202 about a rotational axis 222.

As mentioned above, the body 202, coupler 204, and post 206 may be constructed of a conductive material, such as a suitable metal. Similarly, the exterior/male threads 242 and an axially protruding rim 288 of the port 14 may also be constructed of a suitable conductive metal. Consequently, when the connector 200 is tightened onto the interface port 14, the axially protruding rim 288 may make physical contact with a forward face surface 290 of the post 206 along an abutment interface 302. In FIG. 12, therefore, an electrical grounding path may be produced from the outer conductor 50 of the cable 4, to the post 206, and then from the post 206 to the interface port 14, which may be electrically connected to a grounded structure 320.

In the described embodiment, the body 202 may include a spring-biasing seal 224 operative to form an environmental seal between the body 202 and the coupler 204. This seal 224 prevents the infiltration of foreign objects or debris, which may transgress the bearing interface 218, from entering areas which must remain clean to ensure a reliable electrical ground path across mating interfaces. The spring-biasing seal 224 may be a discrete element disposed at the forward end of the body 202, or be integrally-formed with the body 202 of the connector 200. In the described embodiment, the spring-biasing seal may include a resilient lip 224 projecting from the forward end of the body toward the aft surface 225 of the coupler 204. The resilient lip 224 may comprise an elastomer or urethane element that may be biased toward the aft surface 225 thereby remaining in contact despite relative angular or linear displacement between the coupler 204 and the body 206.

Referring to FIG. 12, the body 202 may include a guide ring 226, a reaction ring 228, and a cylindrical reaction sleeve 230 disposed between the guide and reaction rings 226, 228. The guide ring 226 may be disposed at a forward end 231 of the body 202, and may define a central bore 232 for receiving the post 206. The central bore 232 may be structured to guide and support the post 206 as it moves axially toward the aft end 233 of the body 202, i.e., during assembly. The reaction ring 228 may be located at the aft end 233 of the body 202, may defines the opening/aperture 212 at the aft end of the connector 200, and may function to react radial loads imposed by a retention portion of the post 206. More specifically, the reaction ring 228 may be arranged to react with "hoop" loads induced by a localized expansion of the coaxial cable 4 when the post 206 is inserted between the dielectric core 46 and the outer conductor 50 of the coaxial cable 4. As such, the coaxial cable 4 may be coupled to the connector 200 by a combination of friction loads and a mechanical interlock between the reaction ring 228, elastomer jacket 52, outer conductor 50 and the post 206.

The reaction sleeve 230 may surround or circumscribe the post 206, and, similar to the reaction ring 228, may retain the coaxial cable 4 by trapping the outer conductor 50 and jacket 52 within a fixed dimension. More specifically, the reaction sleeve 230 may react with radial loads imposed by an outer surface of the post 206. In the described embodiment, the diameter of the post 206 may taper, i.e., increase from one end to another. Inasmuch as the volume occupied between the retention sleeve 230 and the post 206 may be fixed, an increase in diameter, and consequently, volume, may increase the friction loads between the mating components, i.e., the reaction sleeve, post 206, cable jacket 52, and the inner conductor 50.

The coupler 204 may include a threaded end 240, an axial recess 244 disposed aft the threaded end 240, and an inwardly facing circumferential groove 248 disposed between the threaded end 240 and the axial recess 244. The threaded end 240 of the coupler 204 may include female threads are operative to threadably engage male threads 242 of the interface port 14. While a threaded connection is illustrated, it should be appreciated that a simple, smooth, non-threaded connection may be employed, i.e., smooth surfaces which axially engage by a friction-fit interface. The axial recess 244 in the aft end of the coupler 204 may facilitate axial displacement of the post 206 when the coupler 204 threadably engages the interface port 14. The displacement of the post 206 will become clear when discussing the assembly of the connector 200.

Figure 10:
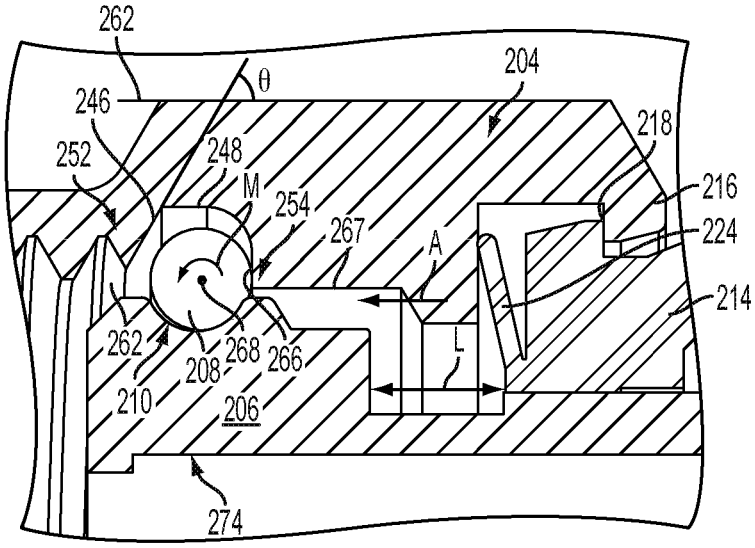
FIG. 10 is an enlarged sectioned and broken away view of one embodiment of the disclosure wherein the sealing member is stored in a seal holding cavity comprising first and second seal cavities or storage surfaces, and wherein the coupler comprises the first seal cavity or storage surface and the post comprises the second seal cavity or storage surface.

In FIG. 10, the inwardly facing circumferential groove 248 of the coupler 204 may be defined by and between a pair of inwardly projecting ridges 252, 254, which may collectively define a first seal storage coupler cavity 248 of the seal holding structure 210. The forward ridge 252 may define a sloping edge 246 defining an angle θ relative to a horizontal line 262 parallel to the rotational axis of the connector 222. The aft ridge 254, on the other hand, may define an abrupt forward facing edge or shoulder 266 that may be oriented substantially at a right angle relative to the horizontal line 262, which may define a substantially abrupt forward edge or shoulder 266. The shoulder 266 may be spatially lower, or radially inboard, of the centroid 268 of the sealing ring 208, such that a moment M may be produced when a shear load is produced along a line separating the coupler 204 from the post 206. The moment couple M tends to lift and/or roll the sealing member 208 up and over the forward ridge 252 of the circumferential groove 248. As a consequence, displacement of the shoulder 266 relative to the post 206 may move the sealing member 208 from its inactive seal position to its active seal position B along the front face of the post 206. This will be discussed in the subsequent paragraph when describing the post 206 in greater detail.

Figure 11:
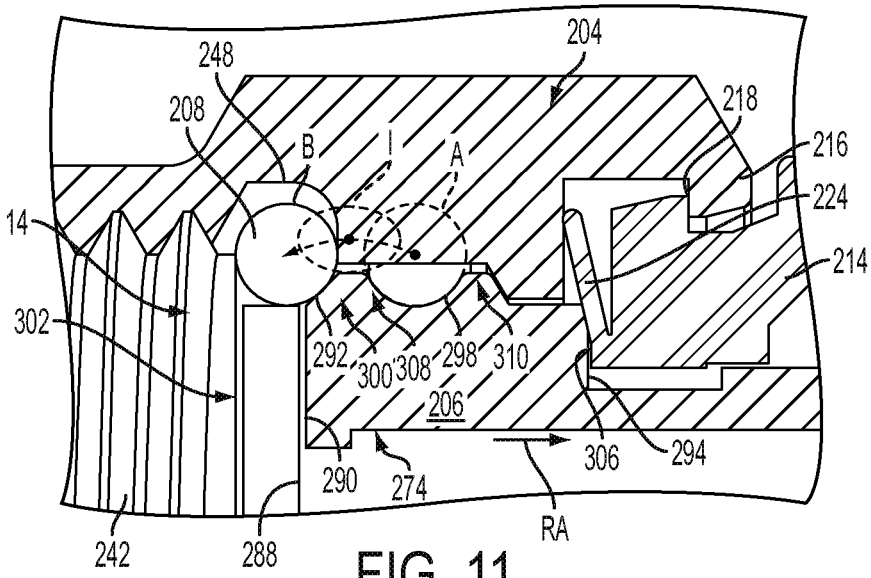
FIG. 11 is an enlarged sectioned and broken away view of one embodiment of the disclosure wherein the first seal storage surface of the coupler is moved to dislodge the sealing member (shown in dashed lines) from the second seal storage surface of the post to reposition the sealing member from its deactivated position to an activated position.

In FIGS. 11 and 12, the post 206 may be received, at least partially, within each of the body 202 and the coupler 204 of the connector 200. More specifically, the post 206 may include a centering or guide portion 270, a head or forward end portion 274 located from the guide portion 270 relative to the forward direction, and a retention portion 278 located aft of the guide portion 270 relative to the aft direction. The guide portion 270 may include a first cylindrical surface 280 having a first diameter, a second cylindrical surface 282 forward of the first cylindrical surface 280 having a second diameter, and a tapered surface 286 disposed therebetween. The tapered surface 286 may increase the diameter dimension from the first to the second cylindrical surfaces, 280 and 282, respectively. Furthermore, the central bore 232 may receive the guide portion 270 of the post 206, and more specifically, may receive the second cylindrical surface 282, or the larger diameter, of the guide portion 270.

The head portion 274 may include a forward surface 290, an aft surface 294, and an outwardly facing circumferential groove or seal retainer 295 disposed between the forward and aft surfaces 290, 294. The circumferential groove or seal retainer 295 may define a second seal storage surface or cavity 298 which, when axially aligned with the first seal storage surface or cavity 248, may define the seal holding cavity 210. The forward surface 290 may face outwardly toward the interface port 14, and may include an arcuate surface 292 operative to seat a portion of the sealing member 208. When seated, the sealing member 208 may seal a cylindrical interface 300 between the coupler 204 and the head portion 274 of the post 206. Additionally, the sealing member 208 may seal an abutment interface 302 between the interface port 14 and the forward surface 290 of the post 206. It will be recalled that the protruding rim 288 of the interface port 14 and the front face surface 290 of the post 206 may define the abutment interface 302 to ground the outer conductor 50 of the coaxial cable.

The aft surface 294 of the head portion 274 may oppose a stop surface 306 formed on the spring-biasing seal 224. The aft surface 294 may abut the stop surface 306 to limit the axial displacement of the post 206. In the described embodiment, the axial displacement of the post 206 equals the depth, or axial length L (see FIG. 10), of the axial recess 244 of the coupler 204.

The outwardly facing circumferential groove or seal retainer 295 of the post 206 may be defined by and between a pair of upwardly facing ridges 308, 310, which may circumscribe the outer periphery of the head portion 274. As mentioned in the preceding paragraph, the outwardly facing circumferential groove 298 (alternative referred to as a concave post surface) of the post 206 and ridges 308, 310 of the post 206 may collectively define a second seal storage surface or cavity 298 of the seal holding cavity 210. As will be discussed hereinafter, the seal holding cavity 210 may be arranged or structured to store and hold the sealing member 208 between the coupler 204 and the post 206 when the seal 208 is in its deactivated or inactive seal position or state A.

The aft retention portion 278 may include a knife-shaped forward edge 312 and an annular barb 316 having a barbed edge 320. During assembly, the knife-shaped forward edge 312 may enter a mating interface 324 between the folded outer conductor 50 and the foil-covered, dielectric core 48 of the coaxial cable 4. Furthermore, the annular barb 316 may be inserted between the outer conductor 50 and dielectric core 48, such that the barbed edge 320 may engage the outer conductor 50 so as to prevent reverse motion of the post 206 relative to the cable 4. Consequently, the barbed edge 320 may prevent the post 206 from backing-away or out from between the outer conductor 50 and dielectric core 48.

In operation and during the manufacture of the connector 200, it may have a sealing member 208 pre-positioned within the seal holding cavity 210. That is, a sealing member 208 may have been installed between the first and second seal cavities 248, 298 of the coupler 204 and post 206, respectively. In this storage, deactivated, or inactive seal position or state A, the sealing member 208 may be pre-positioned, ready to be attached to the interface port 14 at one end and a coaxial cable 4 at the other end. Any of a suitable variety of sealing members 208 may be employed including ring seals, face seals, lip seals, cap seals etc., made from any of a variety of materials including elastomeric, polymeric, thermosetting, and/or urethane materials. In one embodiment, a resilient elastomer that may allow for at least ten percent (10%) elongation may be employed to allow the sealing member 208 to remain seated during preassembly operations, yet allow the resilient elastomer to expand to a larger diameter when being axially displaced/rolled over the forward ridge 308 of the second seal cavity material in one embodiment, the sealing member 208 may be installed/prepared by an automated or robotic assembly system to reduce the possibility of employing an incorrect or incompatible seal in the connector. Even if an automated system is not employed, installation in a controlled work environment (e.g., a factory setting wherein the task of prepositioning a sealing member 208 is free of external distractions and influences) substantially reduces the risk that a seal member will be absent or incorrectly installed.

A properly prepared coaxial cable 4, i.e., a cable 4 that has been stepped and folded, may be received by the opening 212 in the aft end of the connector 200. More specifically, the folded end of the cable 4 may be disposed in opposed relation to the retention portion 278 of the post 206.

The coupler 204 may then be installed onto the threaded interface port 14 and turned to engage the threads 242 of the interface port 14. Rotation of the coupler 204 may cause the interface port 14 to engage the forward surface 290 of the post 206 and drive the post 206 axially into the body 202 of the connector 200.

Axial displacement of the post 206 may effects relative movement between the head portion 274 of the post 206 and the coupler 204. Furthermore, axial displacement may dislodge the sealing member 208 from the its inactive seal position A to an active seal position B. More specifically, the sealing member 208 may be repositioned from between the first and the second seal storage surfaces or cavities 248, 298 to the activated position A between the interface port 14 and the forward surface 290 of the post 206. That is, when the post 206 is urged into the body 202, the forward shoulder 266 of the first seal storage surface or cavity 248 may lift and/or roll the sealing member 208 out of the second seal storage surface or cavity 298 and into a port-accessible or active seal position or space between the face of the post 206 and the interface port 14.

FIGS. 11 and 12 show the relative movement between the coupler 204 and the post 206 according to one embodiment. FIG. 11 shows the movement of the sealing member 208 from its inactive seal position A to an intermediate position I and finally to an active seal position B. More specifically, the sealing member 208 is shown as being moved by the first seal storage surface or cavity 248 to an intermediate position I wherein the seal 208 deforms within the first seal cavity 248 (shown in dashed lines as having an elliptical or irregular shape) to the activated seal position B. In its activated position B, the sealing member 208 may be seated on the arcuate surface 292 to seal the cylindrical and abutment interfaces 300, 302 between the post 206, the coupler 204, and the interface port 14. Further, the arced surface 292 may at least partially mate with the shape of the seal 208. Therefore, the surface 292 may retain the seal 208 in its activated seal position B.

Yet another way to visualize or conceptualize the operation of the activatable seal is to understand that the insert or post 206 and the coupler 204 are arranged to move between a first coupler-to-post position A to a second coupler-to-post position B. In the first coupler-to-post position A, the sealing member 208 is in the inactive seal position between the seal coupler cavity 248 and the seal post cavity 298. While in the first coupler-to-post position the sealing member 208 does not produce or form a seal between the coupler 204 and the insert or post 206. Rather, the seal member is selected and installed in a controlled work environment, free of potential distractions so that the correct seal member 208 is employed.

In the second coupler-to-post position B, the sealing member 208 is in an active seal position, where the sealing member 208 forms a seal between the coupler 204 and the post 206. Relative movement between the coupler 204 and post 206 causes the sealing member 208 to radially expand into the vertical region 256 of the seal coupler cavity 248 as the seal member 208 Is axially displaced along the elongate or longitudinal axis 42 of the connector 200. More specifically, the coupler 204 and post 206 are configured to lift and roll the sealing member 208 from the inactive seal position A to the active seal position B when the post 206 is driven in a rearward direction R into the body 202. The movement is induced by the coupler 204 as it engages the port 14. Such movement may be induced by rotational movement of the coupler 204 as it threadably engages the port 14, or axial movement of the coupler 204 as it is captured or locked in position by a resilient tab or locking device (not shown). Hence, the coupler 204 moves from the first coupler-to-post position to the second coupler-to-post position as the coupler 204 engages the port 14 and the port 14 drives the post or insert 206 rearwardly into the body 202 of the connector 200 and into the prepared end of the coaxial cable 4.

As the post 206 is driven into the connector 200, the retention portion 278 of the post 206 may be driven between the foil-covered dielectric core 46 and the outer conductor 50. Further, when displaced fully, the retention portion 278 may compress the outer conductor 50 and jacket 52 against the reaction ring 228. As such, the barbed edge 320 may form a frictional and mechanical interlock with the outer conductor 50 and jacket 52 of the coaxial cable 4.

In the second coupler-to-post position B, the sealing member 208 seats against the arcuate surface 292 of the post 206, the aft ridge 254 of the coupler 204 and the conductive contact or face surface 43 (FIG. 2) of the port 14. There, the port 14 is driven against the insert or post 206 to effect a grounding contact therebetween. Furthermore, a reliable seal is formed by the sealing member 208 between the coupler 204, post 206 and port 14.

Additional embodiments include any one of the embodiments described above, where one or more of its components, functionalities or structures is interchanged with, replaced by or augmented by one or more of the components, functionalities or structures of a different embodiment described above.

It should be understood that various changes and modifications to the embodiments described herein will be apparent to those skilled in the art. Such changes and modifications can be made without departing from the spirit and scope of the present disclosure and without diminishing its intended advantages. It is therefore intended that such changes and modifications be covered by the appended claims.

Although several embodiments of the disclosure have been disclosed in the foregoing specification, it is understood by those skilled in the art that many modifications and other embodiments of the disclosure will come to mind to which the disclosure pertains, having the benefit of the teaching presented in the foregoing description and associated drawings. It is thus understood that the disclosure is not limited to the specific embodiments disclosed herein above, and that many modifications and other embodiments are intended to be included within the scope of the appended claims. Moreover, although specific terms are employed herein, as well as in the claims which follow, they are used only in a generic and descriptive sense, and not for the purposes of limiting the present disclosure, nor the claims which follow.

The following is claimed:

1. A connector comprising:

a body including a bearing surface and defining a bore disposed about an elongate axis, the body being configured to receive a prepared end of a coaxial cable having a dielectric core disposed between an inner conductor and an outer conductor;

a coupler configured to be rotationally coupled to the bearing surface of the body, engage an interface port, form an inwardly facing coupler groove defining a seal coupler cavity when the connector is assembled, the coupler including a rearward sealing coupler surface;

a post having a head end portion and a rear end portion, the head end portion including a first circumferential ridge and a second circumferential ridge each disposed along an outer periphery of the head end portion, the first and second circumferential ridges configured to together define a seal post cavity when the connector is assembled and before the connector is installed on a cable; and a sealing member configured to fit between the seal coupler cavity and the seal post cavity when the connector is assembled and before the connector is installed on a cable;

wherein the seal coupler cavity and the seal post cavity are configured to cooperate with each other so as to selectively maintain the sealing member in an inactive seal position when the connector is assembled and before the connector is installed on a cable;

wherein the seal post cavity is formed by a concave surface shaped to fit a portion of the sealing member so as to selectively maintain the sealing member in the inactive seal position when the connector is assembled and before the connector is installed on a cable;

wherein the post and the coupler are arranged to move from a first coupler-to-post position, where the sealing member is in an inactive seal position between the seal coupler cavity and the seal post cavity and where the sealing member does not form a seal between the coupler and the post, to a second coupler-to-post position, where the sealing member is in an active seal position and where the sealing member forms a seal between the coupler and the post; and wherein the post and the coupler are configured to lift and roll the sealing member from the inactive seal position to the active seal position when the post and the coupler move from the first coupler-to-post position to the second coupler-to-post position, when the coupler engages an interface port, and when the interface port causes the post to move toward the body;

wherein the first seal coupler cavity includes a shoulder extending away from a longitudinal axis of the connector by a first radial distance, the sealing member defining a centroid extending away from the longitudinal axis of the connector by a second radial distance, the first radial distance of the shoulder being less than the second radial distance of the centroid of the sealing member, and wherein the shoulder is configured to lift the sealing member over the first circumferential ridge when the post and the coupler move from the first coupler-to-post position to the second coupler-to-post position.

2. A connector comprising:

a coupler member configured to engage an interface port, and having an inwardly facing groove portion that forms a seal coupler cavity;

a body member arranged to engage the coupler member and the post member when the connector is assembled, and arranged to engage a cable when the connector is in an installed state, where the coupler member engages the interface port and where the body member engages a cable;

a post member configured to engage the interface port and move toward the body when the connector is installed on the interface port and the cable, the post member having an outwardly facing groove portion formed by a forward and aft ridge, the groove forming seal post cavity; and a seal member configured to fit between the seal coupler cavity and the seal post cavity when the connector is assembled and before the connector is installed between the interface port and the cable;

wherein the post member is configured to move between a first position, where the seal member is maintained in an inactive seal position between the seal coupler cavity and the seal post cavity when the connector is assembled and before the connector is installed on the interface port and the cable, and a second position, where the seal member is in an active seal position spaced away from the inactive seal position, and where the connector is installed between the interface port and the cable; and wherein the seal coupler cavity and the seal post cavity are configured to cooperate together so as to lift and roll the sealing member away from the inactive seal position and to the active seal position when the post moves from the first position to the second position and when the connector is installed between the interface port and the cable;

wherein the coupler engages the interface port during assembly and causes a front face of the post to engage a face surface of the interface port thereby effecting relative movement between the coupler and the post.

3. The connector of claim 2, wherein the coupler and body are connected by a shouldered interface and further comprising a moisture seal between the body and the coupler.

4. The connector of claim 2, wherein the post moves relative to the body and coupler and wherein relative motion effects displacement of the sealing member from the inactive seal position to the active seal position.

5. The connector of claim 2, wherein the sealing member comprises a conductive elastomer to facilitate current flow between the post and an interface port.

6. The connector of claim 2, wherein the sealing member comprises a resilient elastomer capable of at least ten percent (10%) elongation.

7. A connector comprising:

a coupler member defining a coupler seal cavity;

a post member defining a post seal cavity;

a body member configured to engage the coupler member and the post member when the connector is assembled;

a seal member configured to be held in an inactive seal position between the coupler seal cavity and the post seal cavity when the connector is assembled and before the connector is in an port-to-cable installed state, where the coupler member engages an interface port and the body engages a cable; and wherein the post member is configured to move from a first post position, where the seal member is in the inactive seal position and where the seal member does not form a seal between the coupler member and the post member, to a second post position, where the seal member is in an active seal position, and where the seal member forms a seal between the coupler member and the post member, the second post position being spaced away from the first post position; and wherein the coupler seal cavity and the post seal cavity are configured to cooperate together so as to lift and roll the seal member from the inactive seal position to the active seal position when the post member moves from the first post position to the second post position;

wherein when the coupler member engages the interface port, a front face of the post engages a face surface of the interface port, the post moves toward the body from the first post position to the second post position, and the post and couple move relative to one another.

8. The connector of claim 7, wherein the post is driven in a rearward direction such that the sealing member is displaced forwardly from the post seal cavity to a sealed position between the post and the interface port.

9. The connector of claim 7, wherein the post includes a head end portion and a barbed end portion, the head end portion including first and second ridges projecting radially in an outward direction from a central longitudinal axis, the post seal cavity being disposed between the first and second ridges.

10. The connector of claim 7, further comprising a body having a first opening at one end for receiving a prepared end of a coaxial cable and a second opening at an opposite end for receiving the barbed end of the insert.

11. The connector of claim 7, wherein the coupler and body are connected by a shouldered interface and further comprising a moisture seal between the body and the coupler.

12. The connector of claim 7, wherein the post moves relative to the body and coupler and wherein the relative motion effects displacement of the sealing member from the first post position to the second post position.

13. The connector of claim 7, wherein the sealing member comprises a conductive elastomer to facilitate current flow between the post and an interface port.

14. The connector of claim 7, wherein the sealing member comprises a resilient elastomer configured to elongate by at least ten percent (10%) when the sealing member moved between the inactive seal position to the active seal position.

15. The connector of claim 9, wherein the sealing member has a geometric centroid and wherein the first seal cavity includes a shoulder defining a radial distance from a longitudinal axis of the connector, the radial distance of the shoulder being less than a radial distance of the centroid to the longitudinal axis such that the shoulder produces a moment couple to lift the sealing member over to the forward ridge to the active seal position.

16. The connector of claim 2, wherein the sealing member has a geometric centroid and wherein the first seal cavity includes a shoulder defining a radial distance from a longitudinal axis of the connector, the radial distance of the shoulder being less than a radial distance of the centroid to the longitudinal axis such that the shoulder produces a moment couple to lift the sealing member over to forward ridge to the active seal position.

17. A connector comprising:

a coupler defining a first seal cavity;

an insert defining a second seal cavity; and a sealing device configured to form a seal between the coupler and the insert;

wherein the first seal cavity and the second seal cavity are configured to cooperate together to hold the sealing device therebetween in a stowed position when the connector is in a first assembled state, where the connector is not installed on an interface port, and lift and move the sealing device relative to the coupler from the stowed position to an active seal position, where the sealing device forms the seal between the coupler and the insert and when the connector is in a second assembled state, where the connector is installed on an interface port;

wherein the insert includes a port engaging surface, the interface port includes an insert engaging surface, and the insert is configured to move relative to the coupler when the connector is installed on the interface port and when the port engaging surface engages the insert engaging surface.

18. The connector of claim 17, wherein the insert is configured to move in a rearward direction away from the interface port so as to displace the sealing device from the stowed position to the active seal position when the connector is installed on an interface port.

19. The connector of claim 17, wherein the insert includes a head end portion and a barbed end portion, the head end portion including first and second ridges projecting radially in an outward direction from a central longitudinal axis, the second seal cavity being disposed between the first and second ridges.

20. The connector of claim 19, further comprising a body having a first opening at one end for receiving a prepared end of a coaxial cable and a second opening at an opposite end for receiving the barbed end of the insert.

21. The connector of claim 20, wherein the coupler and body are connected by a shouldered interface, and further comprising a moisture seal between the body and the coupler.

22. The connector of claim 21, wherein the moisture seal biases the coupler in a forward direction to maintain a seal while facilitating axial displacement between the coupler and the body.

23. The connector of claim 17, wherein the insert moves relative to the body and coupler and wherein the relative motion effects displacement of the sealing device from the stowed position to the active seal position.

24. The connector of claim 17, wherein the sealing device comprises a conductive elastomer to facilitate current flow between the insert and an interface port.

25. The connector of claim 17, wherein the sealing device comprises a resilient elastomer capable of at least ten percent (10%) elongation.

26. The connector of 17, wherein the sealing device has a geometric centroid and wherein the first seal cavity includes a shoulder defining a radial distance from a longitudinal axis of the connector, the radial distance of the shoulder being less than a radial distance of the centroid to the longitudinal axis such that the shoulder produces a moment couple to lift the sealing device over to forward ridge to the active seal position.

* * * * *